US007810544B2

(12) United States Patent
Spiess

(10) Patent No.: US 7,810,544 B2
(45) Date of Patent: Oct. 12, 2010

(54) DOOR SYSTEM

(75) Inventor: Peter A. Spiess, Meggen (CH)

(73) Assignee: Inventio AG, Hergiswil (CH)

( * ) Notice: Subject to any disclaimer, the term of this patent is extended or adjusted under 35 U.S.C. 154(b) by 71 days.

(21) Appl. No.: 11/923,189

(22) Filed: Oct. 24, 2007

(65) Prior Publication Data

US 2008/0264574 A1 Oct. 30, 2008

(30) Foreign Application Priority Data

Oct. 25, 2006 (EP) ..... 06122910

(51) Int. Cl.
*A47G 5/02* (2006.01)
*A47H 3/00* (2006.01)
*E06B 9/17* (2006.01)

(52) U.S. Cl. ..... 160/242; 160/271; 160/321

(58) Field of Classification Search ..... 160/23.1, 160/31, 37, 242, 265, 133, 274, 310, 319, 160/321
See application file for complete search history.

(56) References Cited

U.S. PATENT DOCUMENTS

| | | | | | |
|---|---|---|---|---|---|
| 19,226 | A | * | 1/1858 | Schleier | 474/136 |
| 53,703 | A | * | 4/1866 | Tarr | 160/265 |
| 146,414 | A | * | 1/1874 | Voorhees | 160/298 |
| 262,398 | A | * | 8/1882 | Gerard | 160/265 |
| 311,906 | A | * | 2/1885 | Massey | 160/239 |
| 439,751 | A | * | 11/1890 | Moore | 160/25 |
| 582,243 | A | * | 5/1897 | Trumble | 160/26 |
| 878,659 | A | * | 2/1908 | McCloud | 160/242 |
| 1,468,832 | A | * | 9/1923 | Parsons | 160/265 |
| 1,591,104 | A | * | 7/1926 | Robinson | 160/298 |
| 1,595,234 | A | * | 8/1926 | Kuyper | 160/23.1 |
| 1,797,321 | A | * | 3/1931 | Cahill | 160/242 |
| 2,323,612 | A | * | 7/1943 | Lombardi et al. | 160/72 |
| 3,357,480 | A | * | 12/1967 | Matsumoto | 160/133 |
| 3,680,622 | A | * | 8/1972 | Lester, Jr. | 160/25 |
| 3,833,045 | A | * | 9/1974 | Sivin | 160/133 |
| 5,172,744 | A | * | 12/1992 | Finch et al. | 160/133 |
| 5,284,199 | A | * | 2/1994 | Finch et al. | 160/133 |
| 5,752,557 | A | * | 5/1998 | Crider et al. | 160/121.1 |
| 5,819,831 | A | * | 10/1998 | Schanz | 160/133 |

(Continued)

FOREIGN PATENT DOCUMENTS

EP 1 447 515 A1 8/2004

(Continued)

*Primary Examiner*—Katherine W Mitchell
*Assistant Examiner*—Jaime F Cardenas-Garcia
(74) *Attorney, Agent, or Firm*—Ladas & Parry LLP

(57) ABSTRACT

A door system has an axis, a door attached at a first end to the axis for winding and unwinding upon the axis, and a tensioned member surrounding and partially engaging an outer layer of the door wound upon the axis. The tensioned member exerts a radial force to the outer layer of the door wound upon the axis, thereby ensuring that the door is consistently wound tightly upon the axis and permitting the fast unrolling of the door from the axis. Although the tensioned member exerts a radial force upon the door, it imparts no significant lateral forces to the door. Accordingly, the door can have a simple construction with material, cost and space savings.

12 Claims, 5 Drawing Sheets

U.S. PATENT DOCUMENTS

| | | | | |
|---|---|---|---|---|
| 6,142,260 | A * | 11/2000 | Shin | 187/333 |
| 7,481,260 | B2 * | 1/2009 | Hagen | 160/265 |
| 2005/0025263 | A1 | 11/2005 | McTavish et al. | |
| 2005/0252623 | A1 * | 11/2005 | McTavish et al. | 160/310 |
| 2006/0000563 | A1 * | 1/2006 | Ito | 160/193 |
| 2006/0037718 | A1 * | 2/2006 | Coenraets | 160/133 |

FOREIGN PATENT DOCUMENTS

| | | | |
|---|---|---|---|
| WO | WO 2005/066445 | * | 7/2005 |
| WO | WO 2005/070807 A | | 8/2005 |

* cited by examiner

DOOR SYSTEM

The invention relates to doors systems and, in particular, to a door system comprising a door that is wound upon a vertical axis during an opening operation. Such door systems have particular utility in elevator constructions.

BACKGROUND OF THE INVENTION

Wound systems are well known from the prior art and are described, for example, in WO-A2-2005/070807 and WO-A2-2005/070808. Each door is generally formed from a stainless steel sheet or interconnected vertical rigid panels, typically manufactured from metal.

In operation, as the elevator door is opened and closed, the plurality of panels or sheet is wound onto and unwound from a vertical axis in the form of a motorized reel whereby the driving force from the motor is transmitted through the reel and laterally onto the door to provide lateral movement thereof. Normally, the door is biased to its closed position by a weight or spring attached to the leading edge of the door. Accordingly, to open the door, the motor must develop a force which to overcome both the inherent friction and also the counteracting biasing force of the weight or spring to provide the necessary opening acceleration. The biasing force exerted through the door not only biases the door to its closed position but also ensures that the door is tightly wound upon the vertical axis as the door is opened. Both the driving force and the biasing force are laterally transmitted though the door and accordingly the door must be sufficiently strong so as to withstand these lateral forces during operation.

Furthermore, to close the door, the closing force developed by the motor must not be greater than the biasing force. Otherwise the door will unwind from the vertical axis at a pace greater than it is drawn across the opening by the biasing force, which will cause the door to bunch up and will cause the door to jam. Thus, the closing speed of the door is effectively limited by the biasing force.

An objective of the present invention is to provide a door construction with lateral forces transmitted through the door while ensuring that, in operation, the door is tightly wound upon the vertical axis.

BRIEF DESCRIPTION OF THE INVENTION

The foregoing objective is achieved by a door system comprising an axis, a door attached at a first end to the axis for winding and unwinding thereupon and further comprising a tensioned member surrounding and partially engaging an outer layer of the door wound upon the axis. Accordingly, the tensioned member exerts a radial force upon the outer layer of the door wound upon the axis, thereby ensuring that the door is consistently wound tightly upon the axis and permitting the fast unrolling of the door from the axis. Furthermore, although the tensioned member exerts a radial force upon the door, it imparts no or no significant lateral forces to the door. Accordingly, the door can have a simpler construction permitting material, cost and space savings.

The tensioned member is preferably endless. Alternatively, the tensioned member may have two opposed ends secured together by a tensioning spring to define a closed loop. As a further alternative, the two opposing ends of the tensioned member can be fixed to the door, either directly or by means of a tensioning spring.

In a preferred arrangement, the tensioned member circumscribes a path from a first pulley to a second pulley, around the outer layer of the door and back to the first pulley. The second pulley increases the wrap angle of the tensioned member around the outer layer of the door, thereby enhancing the engagement between the tensioned member and the outer layer of the door and ensuring more uniform distribution of the radial forces.

The first pulley can be positioned at an opposing side of a doorway to the second pulley and the axis in a simple arrangement, so that the tensioned member extends across the entire doorway.

Alternatively, diverting pulleys can be placed between the first and second pulleys and between the outer layer of the door and the first pulley, respectively, to divert the path of the tensioned member. Accordingly, the axis and all components of the tensioning system can be located on one side of the doorway.

As there are no lateral biasing forces imposed on the door, any motor used to drive the door between its open and closed positions can be more efficient, enabling savings in cost, complexity and space requirement. Such a motor can be used to rotate the axis directly. Alternatively, the motor may be used to rotate the first pulley, which in turn drives the tensioned member and, provided that there is sufficient friction between the tensioned member and the outer layer of the door, results in the selective opening and closing of the door.

The axis may be mounted on a first lever which is rotatable about a fixed pivot point. Accordingly, the net tangential force acting on the outer layer of the door can be used to bias the first lever about the pivot point. This attribute can be used to ensure that the point at which the outer layer of the door engages/disengages with a penultimate door layer is substantially in the plane of a guide channel used to guide the unwound door across the doorway and that the door at this point is substantially in alignment with the guide channel. In operation the door is thus smoothly wound upon the reel directly from the guide channel.

The second pulley may be used not only to deflect the tensioned member but also to limit rotation of the first lever about its pivot point. Alternatively, a separate support member can be used to limit the rotation of the first lever. The support member is positioned along an arc subtended by the axis about the fixed pivot point and aligned with the plane of the door as it moves along the guide channel to ensure that the point of engagement/disengagement of the door is always in the plane of, and in direct alignment with, the guide channel.

Preferably, the first pulley is biased by a spring to impart the required tension into the tensioned member. Alternatively, the first pulley can be biased by a weight to impart the required tension into the tensioned member.

The door system may further comprise a third pulley mounted on a second pivotable lever which is connected to the first lever for concurrent rotation therewith, such that the tensioned member defines an S-shaped path over the second and third pulleys. As the door is unwound from the axis and the first lever rotates about its pivot point, there is a subsequent reduction in the path of the tensioned member around the outer layer of the door. However, since the first and second levers rotate concurrently, this is compensated for by an increase in the path of the tensioned member between the second and third pulleys. Preferably, at least one of the first and second levers is spring biased.

As an alternative to mounting the axis on a lever, the axis can be mounted for movement within a slide channel. Accordingly, as the door is unwound from the axis, the axis is progressively drawn along the slide channel by the net force acting on the outer layer of the wound door.

BRIEF DESCRIPTION OF THE INVENTION

The present invention is hereinafter described by way of specific examples with reference to the accompanying drawings in which.

DETAILED DESCRIPTION OF THE INVENTION

Figure 1:
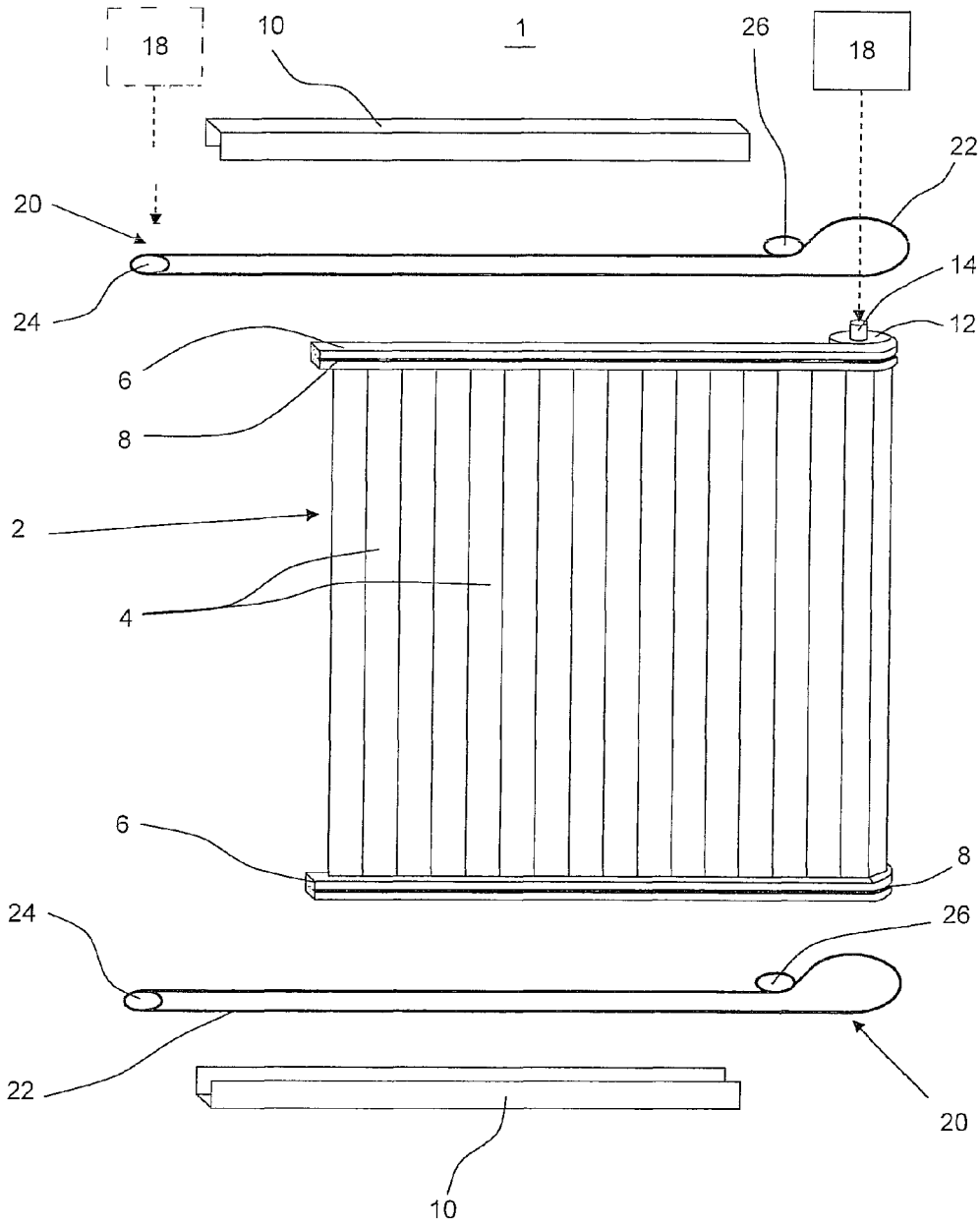
FIG. 1 is an exploded, perspective view which schematically illustrates a general arrangement of a door system according to the present invention.

For the avoidance of unnecessary repetition in the following description, features of the invention which are common to more than one embodiment have been assigned a common reference numeral and where appropriate share a common description.

FIG. 1 is an exploded, perspective view of an elevator door system 1 according to the present invention incorporating a car door 2 which, in use, is used to control access to an elevator car (not shown) through a doorway from a landing within a building. The door 2 is composed of a plurality of vertically aligned panels 4 bound at their upper and lower extremities by flexible belts 6. Each of the panels 4 is preferably extruded from aluminium for its superior strength to weight ratio. The belts 6 are attached at one end to a reel 12 mounted at one side of the doorway. The reel 12 can be rotated about its axis 14 by a motor 18 to open and close the door 2. In operation, the door 2 is guided across the doorway in upper and lower guide channels 10. Alternatively, the motor 18 can be used to drive return pulley 24, as shown in phantom.

The door system 1 further comprises an upper and a lower tensioning system 20 each comprising a pre-tensioned, endless belt 22 which circumscribes a path around a return pulley 24, over a deflection pulley 26, around the outer layer of the door 2 wound upon the reel 14, and back to the return pulley 24. This arrangement ensures that the door 2 is tightly wound upon the reel 14 since each endless belt 22 consistently exerts a radial force on the outer layer of the door 2 wound upon the reel 10. Furthermore, the arrangement enables the endless belts 22 to run freely alongside any portion of the door 2 which has been unwound from the reel 12 and into the guide channels 10. Accordingly, although each endless belt 22 exerts a radial force to the door 2 on the reel 12 to ensure it is wound tightly upon the reel, it imparts no lateral force to the door 2.

In the present example, each endless belt 22 is partially accommodated within a groove 8 provided in the respective flexible belt 6 of the door 2 for guidance and to ensure correct positioning during operation.

Figure 2A:
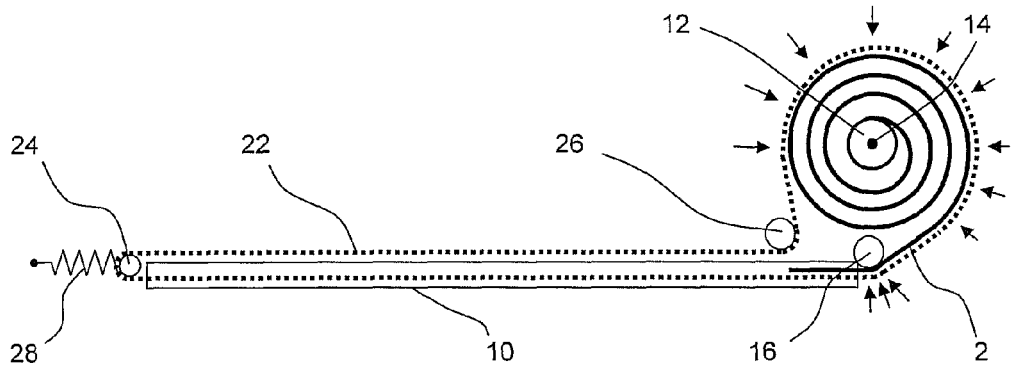
FIGS. 2A and 2B are plan views of a door system according to a first embodiment of the present invention illustrating the door in an open position and a closed position, respectively.

FIG. 2A is a plan view of a door system 1 according to a first embodiment of the invention. The system 1 is illustrated in an open position wherein the majority of the door 2 is wound upon the reel 12. The reel 12 is fixed via its axis 14 at the right side of the doorway. A guide surface in the form of guidance roller 16 which, in operation, guides the door 2 into and out of the guide channel 10, as well as deflection pulley 26 of the tensioning system 20, are also located on the right side of the doorway. Return pulley 24 is fixed via a biasing spring 28 to the left side of the doorway.

The endless belt 22 (depicted by a hashed line) extends from the return pulley 24 across the doorway to the deflection pulley 26, around the outer layer of the door 2 wound upon the reel 12, about the guidance roller 16 and back to the return pulley 24. The biasing spring 28 exerts a force on the return pulley 24 which in turn imparts a tension into the endless belt 22. The thus tensioned endless belt 22 exerts radial forces (indicated by the arrows in FIG. 2A) to that portion of the outer layer of the door 2 with which it engages and also imparts radial forces to the door 2 as it passes over the guidance roller 16. Accordingly, although the tensioning system 20 exerts no lateral force on the door 2, it still ensures that the door 2 can be tightly wound upon the reel 12 and that the door 2 can be quickly unwound from the reel 12 without jamming.

Figure 2B:
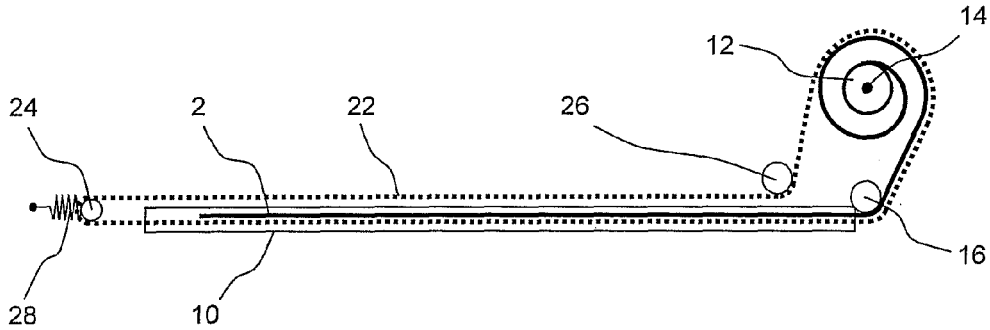

In a closing operation, the motor 18 rotates the reel 12 clockwise and the door 2 is progressively unwound from the reel 12 and guided by the guidance roller 16 into the guide channel 10, as shown in FIG. 2B. This progressive reduction in the outer diameter of the door 2 wound upon the reel 12 causes a corresponding reduction in the path length of the endless belt 22 between the deflection pulley 26 and the guidance roller 16. However, this effect is compensated for by the gradual contraction of the biasing spring 28 and accordingly the length of the endless belt 22 remains substantially constant throughout operation.

As an alternative to the guidance roller 16, any suitable surface that guides the door 2 smoothly into and out of the guide channel 10 can be either integrated into or provided at the entrance of the guide channel 10.

Figure 3A:
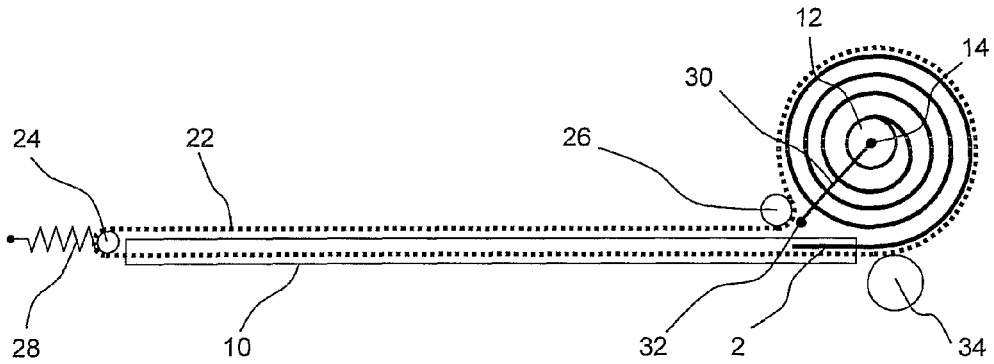
FIGS. 3A and 3B are plan views of a door system according to a second embodiment of the present invention illustrating the door in an open position and a closed position, respectively.

FIG. 3A is a plan view of a door system 1 according to a second embodiment of the invention. The system 1 is illustrated in an open position wherein the majority of the door 2 is wound upon the reel 12. In this embodiment, the axis 14 of reel 12 is no longer fixed but instead is mounted to upper and lower levers 30 which can rotate about corresponding fixed pivot points 32. For clarity, only a single lever 30 and pivot point 32 are shown in the drawing and further described. The endless belt 22 engages with the upper left, upper right and lower right quadrants (as shown in the figure.) of the outer wrapped layer of the door 2. The radial forces exerted by the endless belt 22 in the upper left and lower right quadrants effectively counteract each other and hence the net force on the outer layer of the door 2 acts through the upper right quadrant. This net force tends to bias the lever 30 clockwise about its fixed pivot point 32 but motion under this biasing force is limited by a fixed support roller 34 acting on the outer layer of the door 2.

The fixed support roller 34 is positioned such that the point at which it engages with the door 2 is along an arc subtended by the reel axis 14 about the fixed pivot point 32. This arrangement of the support roller 34 ensures that the point at which the outer layer of the door 2 engages/disengages with the penultimate door layer on the reel 12 is in the plane of the guide channel 10 and that the door 2 at this point is in alignment with the guide channel 10. Hence, in operation, the door 2 is smoothly continuously wound upon the reel 12 directly from the guide channel 10.

Figure 3B:
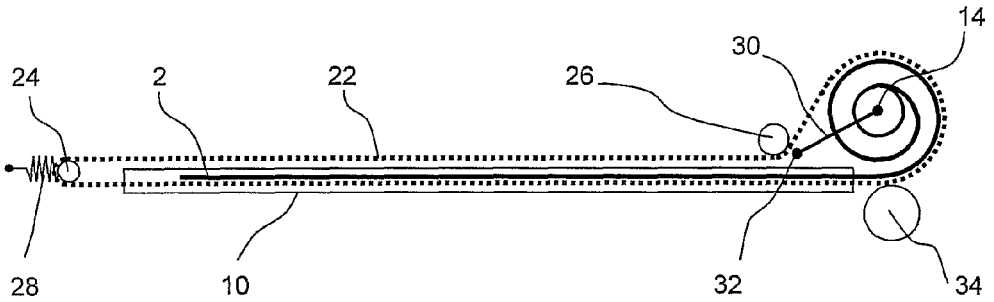

In a closing operation, the motor 18 rotates the reel 12 clockwise about its axis 14 and the door 2 is progressively unwound from the reel 12 directly into the guide channel 10, as shown in FIG. 3B. The net radial force imparted to the outer wound layer of the door 2 by the endless belt 22 biases the reel 12 towards the support roller 34 and accordingly the lever 30 rotates clockwise about its pivot point 32. As in the previously described embodiment, the spring 28 gradually contracts to compensate for the effects of the progressive reduction in the outer diameter of the door 2 wound upon the reel.

Figure 4A:
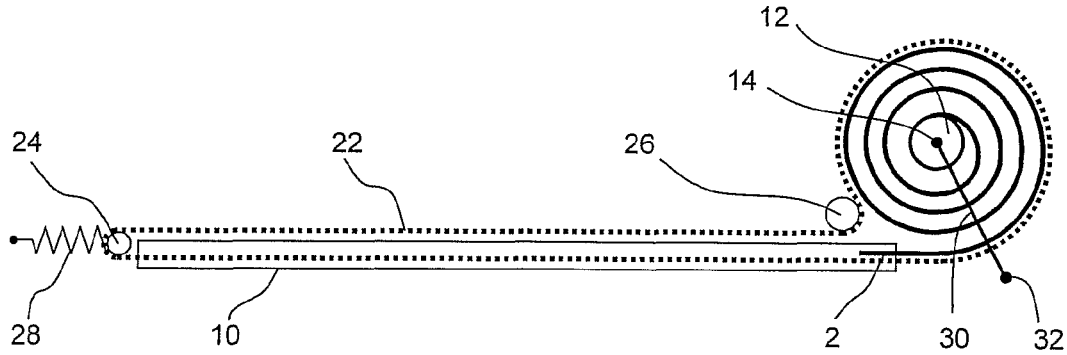
FIGS. 4A and 4B are plan views of a door system according to a third embodiment of the present invention illustrating the door in an open position and a closed position, respectively.
Figure 4B:
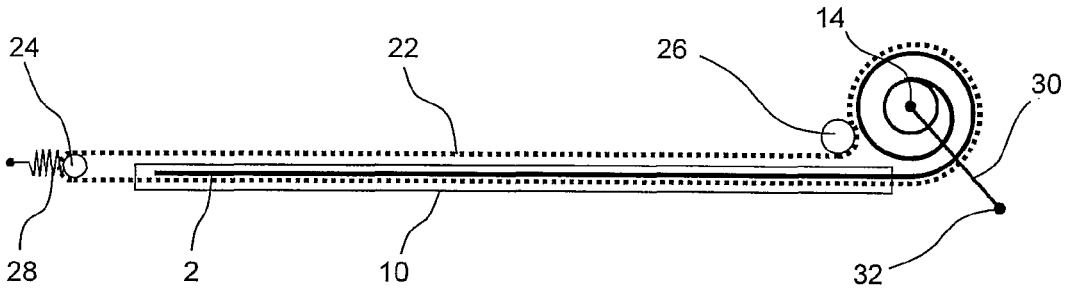

The skilled person will readily appreciate that lever 30 can be arranged differently. Such an alternative arrangement is illustrated in FIGS. 4A and 4B. In this embodiment, the fixed pivot point 32 of the lever 30 has been transferred to the opposing side of the guide channel 10 and the support roller 34 of the previous embodiment has been removed. The net force acting on the outer layer of the wound door 2 (through the upper right quadrant) biases the reel 14 towards the deflection pulley 26 which as well as deflecting the endless belt 22 also serves to limit the rotation of the lever 30 about its pivot point 32. The fixed pivot point 32 of the lever 30 and the deflection pulley 26 can be arranged to ensure that the point at which the outer wound layer of the door 2 engages/disengages with the penultimate door layer on the reel 12 is substantially in the plane of the guide channel 10 and that the door 2 at this point is substantially in alignment with the guide channel 10. Hence, in operation, the door 2 is smoothly wound upon the reel 12 directly from the guide channel 10.

On closing, the motor 18 rotates the reel 12 clockwise about its axis 14 and the door 2 is progressively unwound from the reel 12 and into the guide channel 10, as shown in FIG. 4B. The net radial force imparted to the outer layer of the door 2 by the endless belt 22 biases the reel 12 towards the deflection pulley 26 and accordingly the lever 30 rotates counter-clockwise about its pivot point 32. As in the previously described embodiments, the spring 28 gradually contracts to compensate for the effects of the progressive reduction in the outer diameter of the door 2 wound upon the reel 12.

Figure 5A:
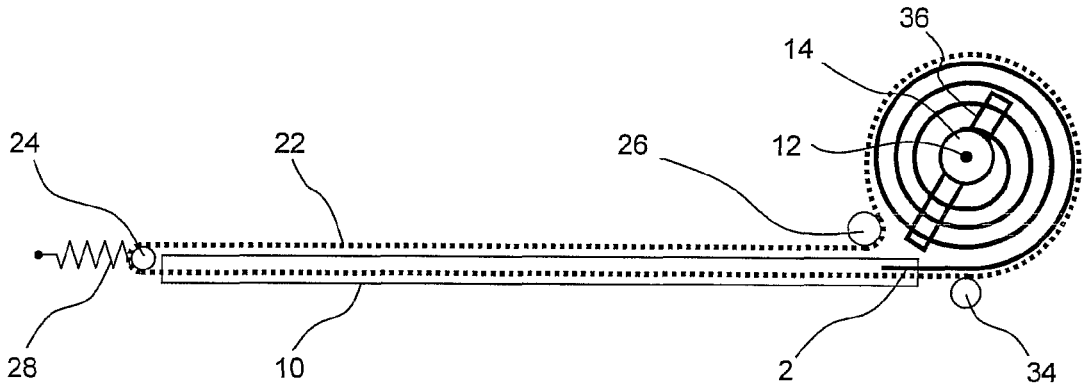
FIGS. 5A and 5B are plan views of a door system according to a fourth embodiment of the present invention illustrating the door in an open position and a closed position, respectively.
Figure 5B:
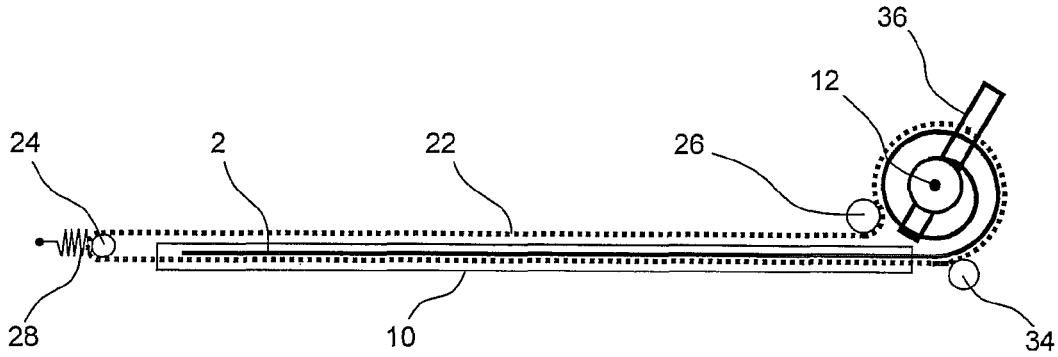

FIGS. 5A and 5B are plan views of a door system 1 according to a fourth embodiment of the invention in which the reel axis 14 is mounted on conventional bearings within upper and a lower slide channels 36. For clarity, only one of the slide channels 36 is shown in the drawing and further described. The reel 12 can rotate about its axis 14 and the axis 14 can move along the path defined by the slide channels 36. The net radial force imparted to the outer layer of the door 2 by the endless belt 22 biases the reel 12 towards the deflection pulley 26 and the support roller 34. Accordingly, on closing, as shown in FIG. 5B, the door 2 is unwound from the reel 12 and the reel axis 14 is drawn along the slide channel 36 towards the deflection pulley 26 and the support roller 34 by the net force acting on the outer layer of the wound door 2. As in the previously described embodiments, the spring 28 gradually contracts to compensate for the effects of the progressive reduction in the outer diameter of the door 2 wound upon the reel 12.

It will be appreciated that the support roller 34 can be replaced by any suitable surface which permits the door 2 to move smoothly alongside it.

Figure 6A:
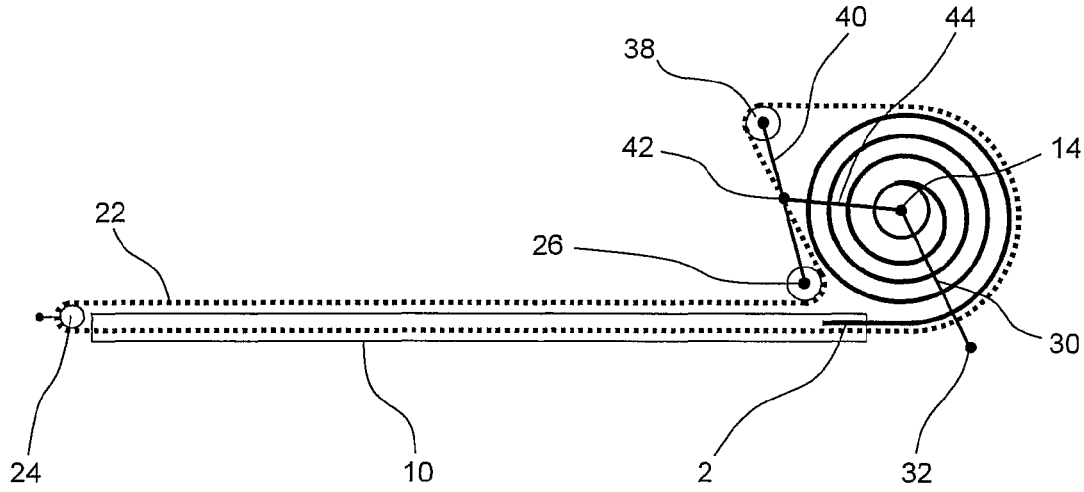
FIGS. 6A and 6B are plan views of a door system according to a fifth embodiment of the present invention illustrating the door in an open position and a closed position, respectively.
Figure 6B:
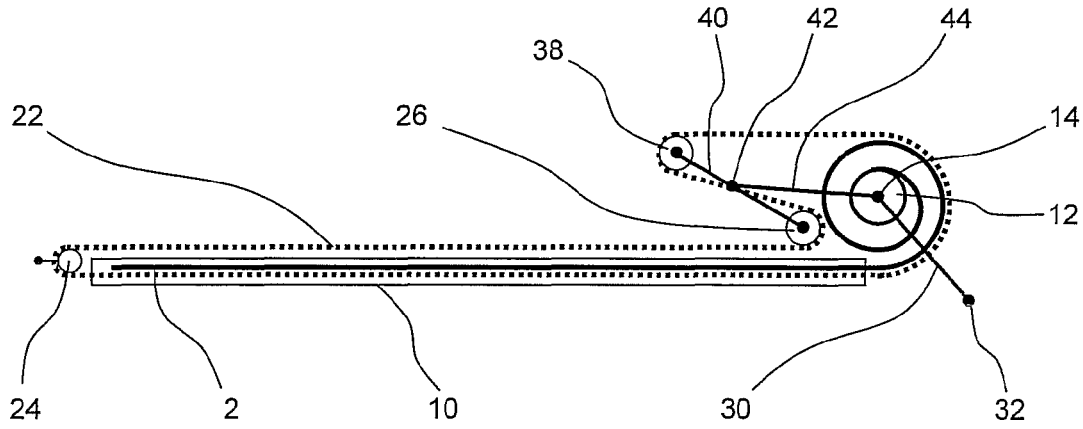

In the previously described embodiments, the biasing spring 28 which fixes the return pulley 24 to the left side of the doorway expands or contracts to compensate for the increase or reduction in the path length of the endless belt 22 about the outer layer of the wound door 2 as the door 2 is opened or closed, respectively. An alternative arrangement providing the same functionality is depicted in FIGS. 6A and 6B. The door system 1 contains an upper and a lower h-shaped linkage. For clarity, only one of the h-shaped linkages is shown in the drawings and further described. The linkage comprises a first lever 30 connecting the reel axis 14 to a fixed pivot point 32, a second lever 40 connecting a fixed deflection pulley 26 to a second deflection pulley 38, and a link 44 connecting the reel axis 14 to an intermediate hinge 42 on the second lever 40. Although not shown, the second lever 40 is spring biased about the fixed deflection pulley 26 in the counter-clockwise direction.

The endless belt 22 extends from the return pulley 24, which is securely fixed to the left side of the doorway, ascribes an S-shaped path over the deflection pulleys 26 and 38, partially engages with the outer layer of the door 2 wound upon the reel 14, and returns back to the fixed return pulley 24. The spring biased second lever 40 imparts a tension into the endless belt 22. The thus tensioned endless belt 22 exerts radial forces to the outer layer of the door 2 with which it engages. Accordingly, although the endless belt 22 exerts substantially no lateral force on the door 2, it still ensures that the door 2 can be tightly wound upon the reel 12 and that the door 2 can be quickly unwound from the reel without jamming.

Furthermore, the spring biased second lever 40 also tends to bias the entire h-shaped linkage counter-clockwise about the fixed deflection pulley 26 and the fixed pivot point 32. As in the embodiment of FIG. 4, the fixed deflection pulley 26, as well as deflecting the endless belt 22 also serves to limit the rotation of the first lever 30 about its pivot point 32. The fixed pivot point 32 of the first lever 30 and the fixed deflection pulley 26 can be arranged to ensure that the point at which the outer layer of the door 2 engages/disengages with the penultimate door layer on the reel 12 is substantially in the plane of the guide channel 10 and that the door 2 at this point is substantially in alignment with the guide channel 10. Hence, in operation, the door 2 is smoothly wound upon the reel 12 directly from the guide channel 10.

In a closing operation, the motor 18 rotates the reel 12 clockwise about its axis 14 and the door 2 is progressively unwound from the reel 12 directly into the guide channel 10, as shown in FIG. 6B, and the spring biasing of the second lever 40 skews the entire h-shaped linkage counter-clockwise about the fixed deflection pulley 26 and the fixed pivot point 32. Although there is a subsequent reduction in the path of the endless belt 22 around the outer layer of the door wound upon the reel 12, this is compensated for by an increase in the path of the endless belt between the fixed deflection pulley 26 and the point at which it engages the outer door layer.

In a further alternative arrangement, the motor 18, instead of rotating the reel 12 about its axle 14, can be positioned at the opposing side of the doorway to rotate the return pulley 24, provided that there is sufficient friction between the endless belt 22 and the groove 8 provided in the flexible belt 6 of the outer layer of the door 2 wound upon the reel 12. Although this arrangement is particularly apt for use in the door system shown in FIGS. 6A and 6B as the return pulley 24 is securely held in position, it can also be used as an alternative for embodiments in which the return pulley 24 is spring biased.

For illustrative purposes, the endless belt 22 has been depicted in FIGS. 2 to 6 as being displaced from the outer layer of the door 2 wound upon the reel 12, however it will be appreciated that since the endless belt 22 is partially accommodated within the groove 8 provided in the flexible belt 6 of the door 2, the path of the endless belt 22 is in fact substantially concurrent with the door 2.

A person skilled in the art will acknowledge that a rope, cable, wire or any other endless member which is capable of withstanding the appropriate pre-tension can be used in place of the endless belt 22 to exert radial or tangential forces on the outer layer of the door 2 wound upon the reel 10.

It will also be appreciated that the belt, rope, cable or wire need not be endless. For example, the invention can be realized using a belt having first and second opposing ends wherein the first end is secured to the door 2 at a first fixation point in the vicinity of the leading door panel 4, and the belt extends therefrom along the same path shown in FIG. 1 about the return pulley 24, the deflection pulley 26, and the outer layer of the door 2 to the second end secured to the door at a second fixation point close to the first fixation point. Accordingly, the tension is transmitted in a closed-loop path, the majority of which is defined by the belt with a small minority being defined by the door between the two fixation points. Although such an arrangement inherently transmits lateral forces through the door, it is only through a small section of the door defined by the distance between the two fixation points, rather than through the entire door as in the prior art.

Furthermore, the second belt end can be secured to the second fixation point by a spring to impart the required tension into the closed-loop path and to compensate for the effects of the progressive changes in the outer diameter of the door 2 wound upon the reel 12 in operation. Accordingly, the biasing spring 28 used in the embodiments of FIGS. 2-5 is no longer required. In fact, the same benefit can be derived from an arrangement wherein the two ends of the belt are not secured to the door 2, but are connected together by the spring.

Although the deflection pulley 26 increases the wrap angle of the endless member around the outer layer of the door, thereby enhancing the engagement between the endless member and the outer layer of the door and ensuring more uniform distribution of the radial forces, it will be appreciated that the deflection pulley 26 is not essential for the invention.

Figure 7:
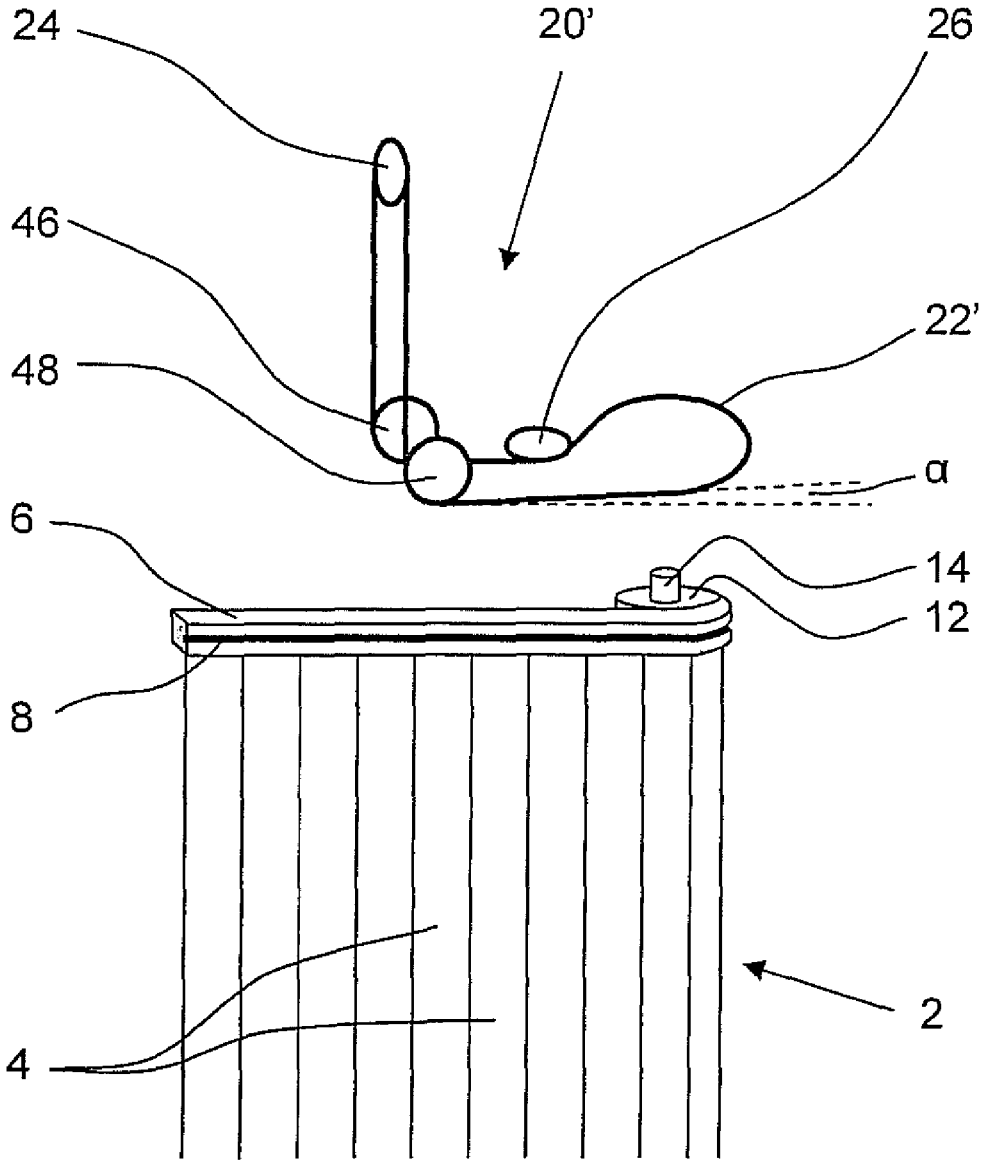
FIG. 7 is an exploded partial perspective view which schematically illustrates an alternative arrangement of the door system of FIG. 1.

FIG. 7 is an exploded partial perspective view of an elevator door system 1 according to the present invention incorporating an alternative tensioning system 20' to that illustrated in FIG. 1. The tensioning system 20' comprises a pre-tensioned, endless rope or cable 22' having a circular cross-section. Instead of extending across the entire doorway, the cable 22' is diverted upwards to the return pulley 24 arranged above the door 2 by diverting pulleys 46 and 48. Accordingly, the cable 22' circumscribes a path down from the return pulley 24, under a first diverting pulley 46 and into the horizontal plane, to the deflection pulley 26, around the outer layer of the door 2 wound upon the reel 14, alongside the path of the door 2 as it is unwound from the reel 14, diverted by the second diverting pulley 48 into the vertical plane and back to the return pulley 24. To ensure that the endless cable 22' is sufficiently withdrawn from the groove 8 in the door belt 6 before being diverted upwards, the second diverting pulley 48 is arranged so that the path of the cable 22' between the outer layer of the door 2 and the second diverting pulley 48 makes a slight horizontal angle $\alpha$ away from the path of the door 2 as it moves along the guide channel 10.

This alternative arrangement of the tensioning system 20' can be used in conjunction with any of the embodiments shown in FIGS. 2 to 6.

Although the invention has been specifically described for use as an automatic door system for use on an elevator car within an elevator installation, it can equally be applied to a manual system or used in different technical fields. Furthermore, the invention can be easily adapted for horizontal as well as vertical use.

I claim:

1. A door system comprising a reel rotatable about an axis, a door attached at a first end to the reel for opening and closing a passageway extending across a doorway between a first lateral side and an opposed second lateral side thereof by guided horizontal travel between the lateral sides and for winding and unwinding upon the reel as it rotates upon the axis, and a tensioned member surrounding and partially engaging an outer layer of the door as wound upon the reel wherein the tensioned member circumscribes a path from a first pulley at the first lateral side of a doorway across which the door opens and closes to a second pulley at a position at the second, opposite lateral side of the doorway remote from the first pulley, around the outer layer of the door wound upon the reel, and back to the first pulley.

2. A door system according to claim 1, further comprising a motor to rotate the reel about the axis.

3. A door system according to claim 1, further comprising a motor to rotate the first pulley.

4. A door system according to claim 1, wherein the axis is mounted on a first lever rotatable about a fixed pivot point.

5. A door system according to claim 4 further comprising a support member to limit rotation of the first lever about the pivot point.

6. A door system according to claim 4, further comprising a third pulley mounted on a second pivotable lever connected to the first lever for concurrent rotation therewith.

7. A door system according to claim 1, wherein the first pulley is biased by a spring.

8. A door system according to claim 6, wherein at least one of the first lever and the second lever is spring biased.

9. A door system according to claim 1, wherein the axis is mounted for movement along a path defined by a channel.

10. An elevator having a door system according to claim 1.

11. A door system according to claim 2, wherein the reel is pivotable about a fixed pivot point.

12. A door system according to claim 2, wherein the path circumscribed by the tensioned member between the first and second pulleys is at least partially within a groove in the door.

* * * * *